US006217371B1

(12) United States Patent
Wu

(10) Patent No.: US 6,217,371 B1
(45) Date of Patent: Apr. 17, 2001

(54) MODULAR CONNECTOR

(75) Inventor: Kun-Tsan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/447,160

(22) Filed: Nov. 22, 1999

(30) Foreign Application Priority Data

Dec. 28, 1998 (TW) ..... 87221654

(51) Int. Cl.[7] ..... H01R 3/00
(52) U.S. Cl. ..... 439/490; 439/676
(58) Field of Search ..... 439/676, 607, 439/609, 488, 490, 701

(56) References Cited

U.S. PATENT DOCUMENTS 5,685,737 * 11/1997 Morin et al. ..... 439/490
5,704,802 * 1/1998 Loudermilk ..... 439/490
5,876,240 * 3/1999 Derstine et al. ..... 439/490
5,885,100 * 3/1999 Talend et al. ..... 439/490
5,924,890 * 7/1999 Morin et al. ..... 439/490
5,957,730 * 9/1999 Wang ..... 439/490
5,975,943 * 11/1999 Chou et al. ..... 439/490

* cited by examiner

*Primary Examiner*—Gary F. Paumen
(74) *Attorney, Agent, or Firm*—Wei Te Chung

(57) ABSTRACT

A modular connector of the present invention comprises an insulative housing, at least two terminal modules, a shell for enclosing the insulative housing and indicating devices. The insulative housing defines at least two mating cavities in a front portion and at least two insert openings in a bottom wall thereof. The terminal modules each comprise a plurality of contacts injection molded in a spacer thereof and are inserted into the insert openings from a bottom side of the insulative housing. The indicating devices are received in first receiving grooves defined in the insulative housing for signaling circuit transmission. The shell encloses the insulative housing while providing openings for insertion of at least two mating connectors and apertures for protrusion of the indicating devices therethrough.

1 Claim, 5 Drawing Sheets

MODULAR CONNECTOR

BACKGROUND OF THE INVENTION

The present invention relates to a connector, and particularly to a modular connector for mating with different electric connectors and comprising a group of indicating devices.

In order to make full use of the space on a PCB in computers, molded electrical connectors have become a trend in the development of computers and a number of designs for molded electrical connectors have been developed. The modular connectors disclosed in prior art Taiwan patent application Nos. 85217540 and 8609808 do not make full use of the space between electrical connectors, resulting in a modular connector that is larger than it need be. Additionally, in assembly, the insertion direction of the terminal module is the reverse of that of a mating connector, thus, when the mating connector is inserted, it tends to push the terminal module out of its position and thereby adversely affects the contact between the module and the mating connector. Hence, an improved design for a modular connector is required to overcome the disadvantages of the prior art.

BRIEF SUMMARY OF THE INVENTION

A first object of the present invention is to provide a modular connector which can minimize the side-by-side space between the mating connectors received therein;

A second object of the present invention is to provide a modular connector which can be securely assembled and is fitted with indicating devices for signaling circuit transmission.

A third object of the present invention is to provide a modular connector which can prevent the conductive contacts therein from breaking off during mating.

A modular connector of the present invention comprises an insulative housing, terminal modules, a shell and indicating devices. The insulative housing defines at least two mating cavities in a front portion and two arranging openings communicating with the mating cavities in a top portion thereof, both of which are adapted for insertion of mating connectors. A first receiving groove is defined in the housing at one side of each arranging opening for accommodating an indicating device. Second receiving grooves are defined in a rear wall of the insulative housing in communication with respective first receiving grooves. Insert openings are defined in a bottom wall of the insulative housing for insertion of corresponding terminal modules. Each terminal module comprises a plurality of conductive contacts molded in a spacer and is inserted into the insulative housing from the insert opening thereof. The shell encloses the insulative housing to provide EMI shielding. A front side of the shell defines receiving openings aligned with the mating cavities of the insulative housing and apertures aligned with the first receiving grooves in the insulative housing. The indicating devices are received in the first and second receiving grooves of the insulative housing. A front end of each indicating device extends out of an aperture of the shell to show the state of circuit transmission.

Other objects, advantages and novel features of the invention will become more apparent from the following detailed description of the present embodiment when taken in conjunction with the accompanying drawings.

DETAILED DESCRIPTION OF THE INVENTION

Figure 1:
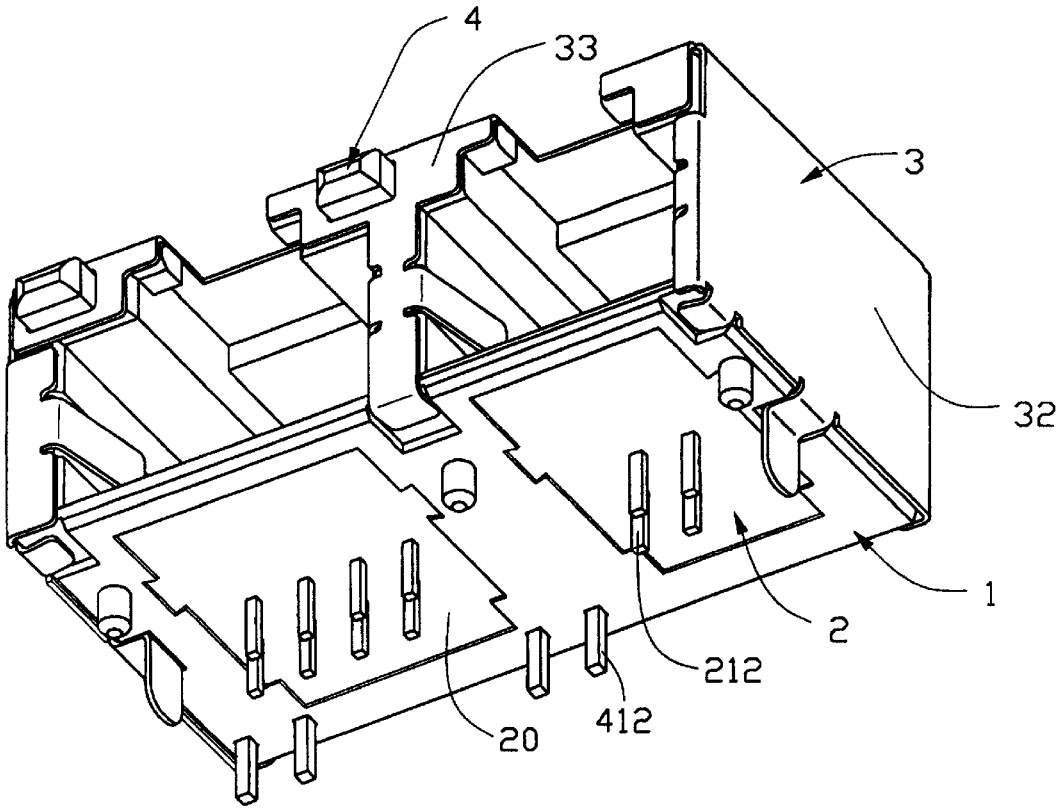
FIG. 1 is a perspective view of a modular connector of the present invention.
Figure 2:
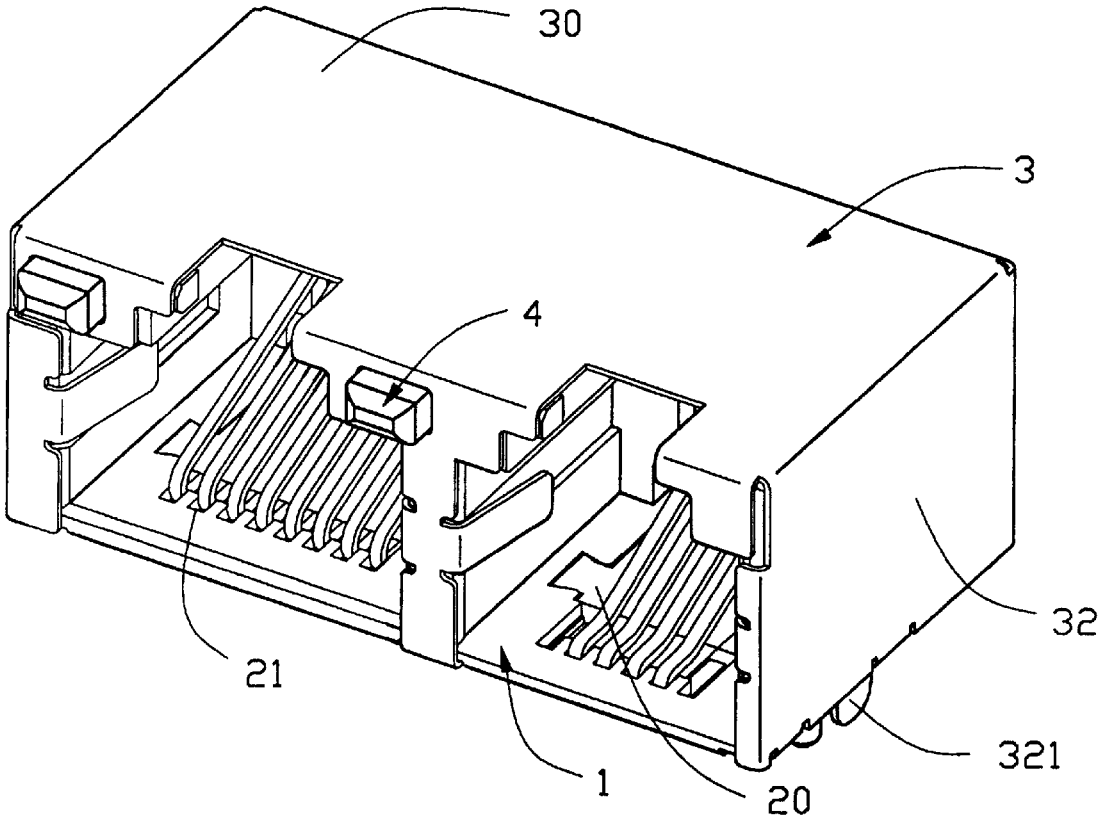
FIG. 2 is a perspective view of FIG. 1 from another aspect.
Figure 3A:
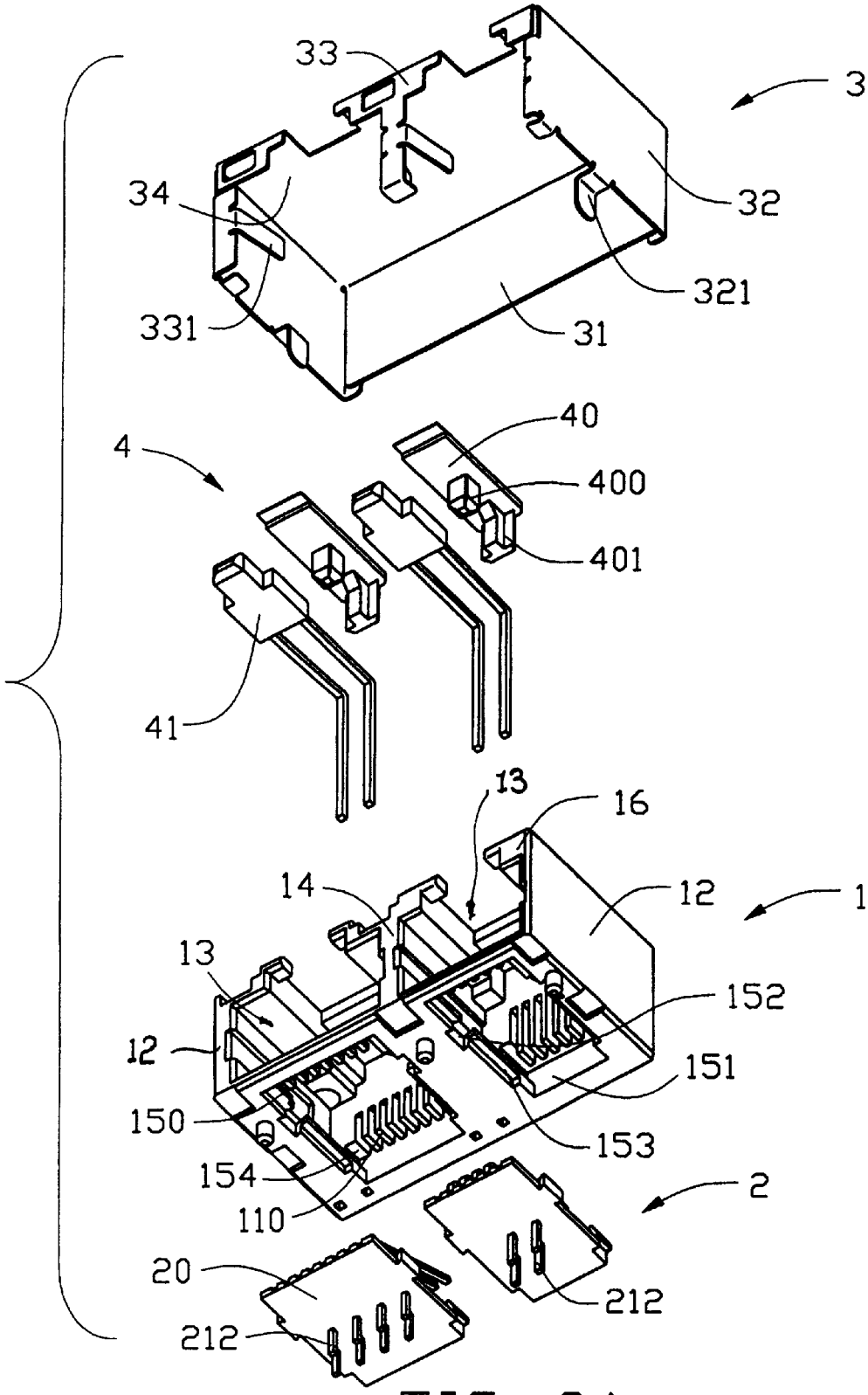
FIG. 3A is an exploded perspective view of FIG. 1 from a bottom aspect.
Figure 3B:
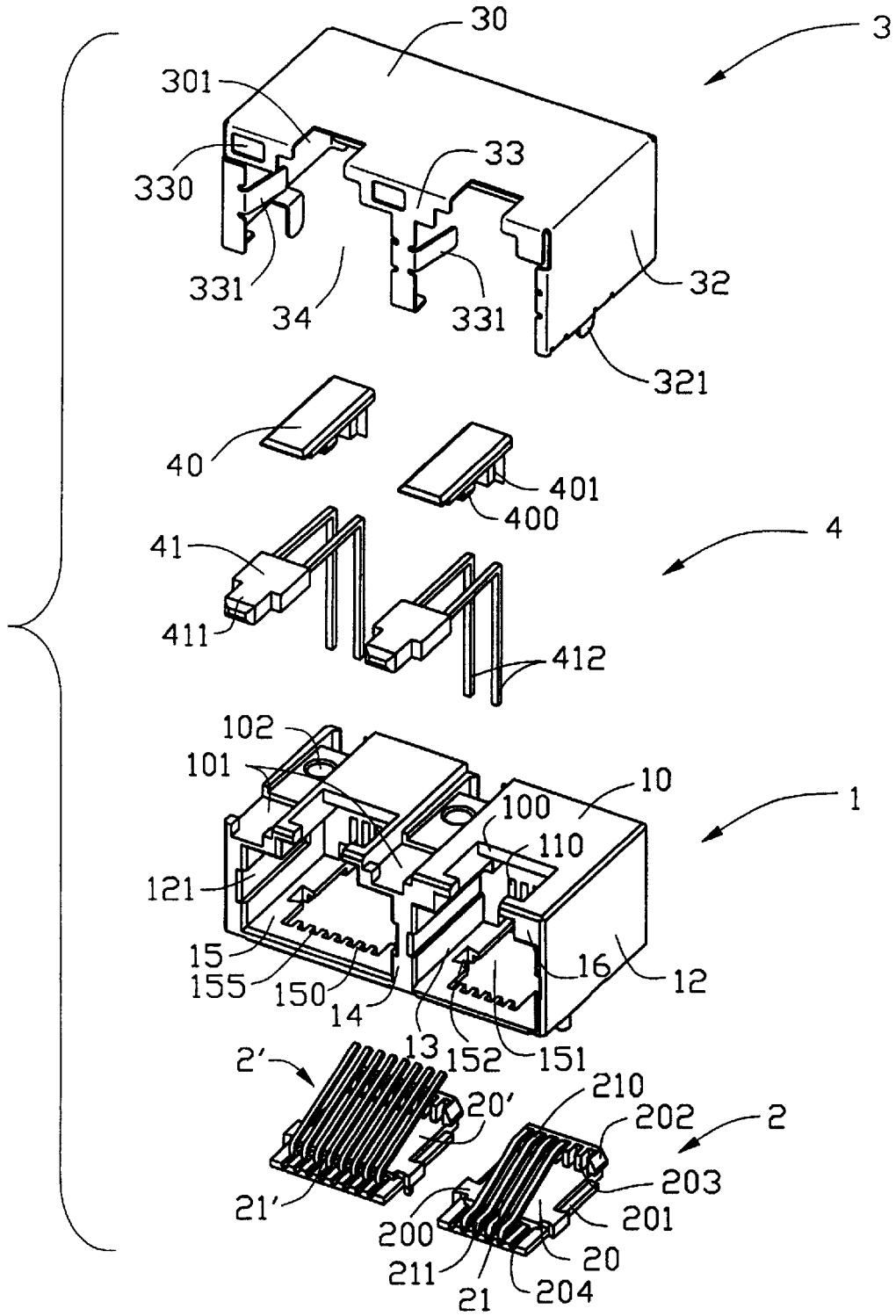
FIG. 3B is an exploded perspective view of FIG. 1 from a front aspect.
Figure 3C:
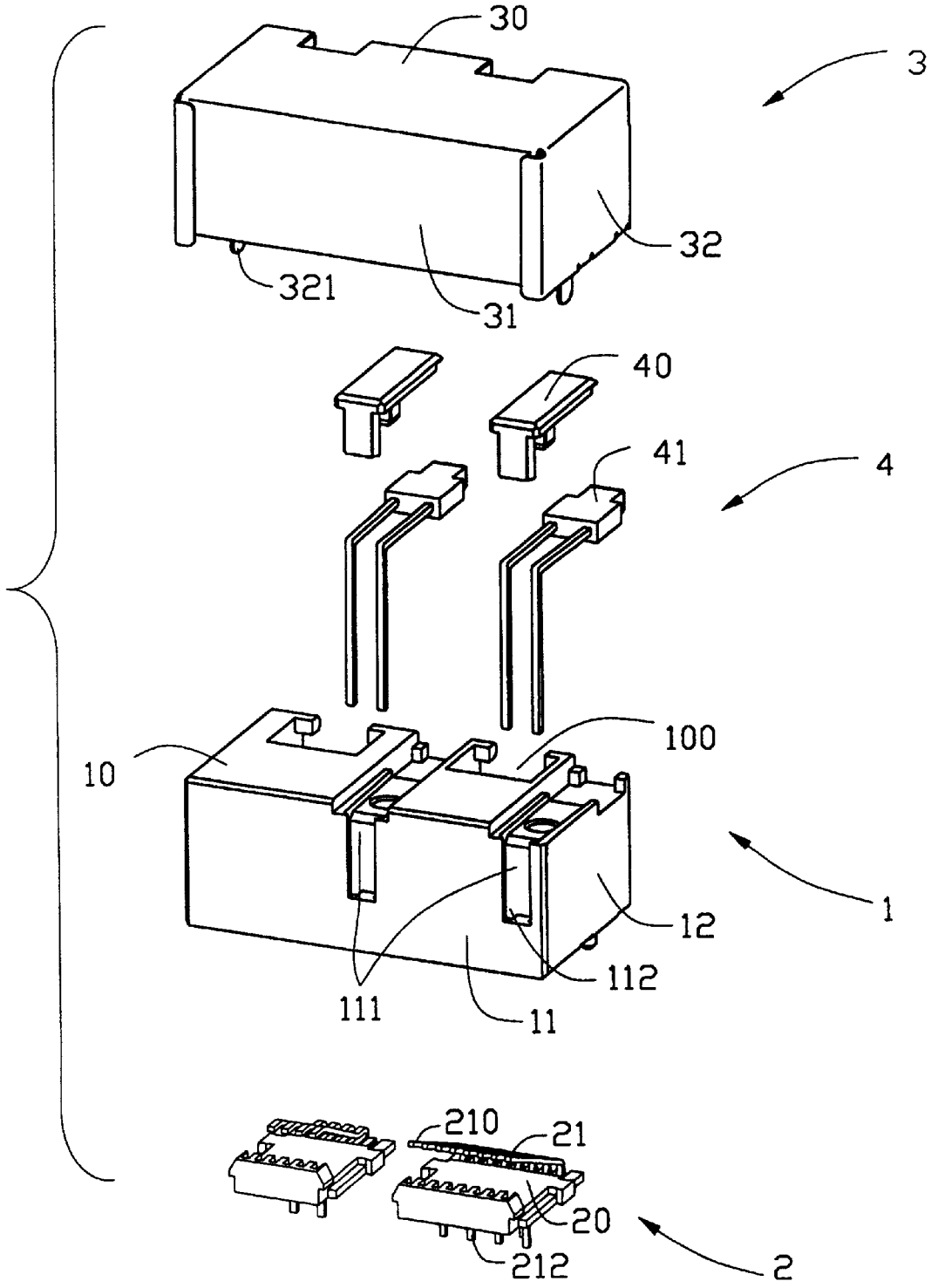
FIG. 3C is an exploded perspective view of FIG. 1 from a rear aspect.

Referring to FIGS. 1, 2, 3A and 3B, a modular connector of the present invention generally composed of a large unit and a small unit side by side integrally arranged together, comprises an insulative housing 1, terminal modules 2 and 2', a shell 3 and indicating devices 4. The insulative housing 1 is in a rectangular shape and comprises a top portion 10 and an opposed bottom wall 15, a front portion 16 and an opposed rear wall 11 (referring to FIG. 3C), and two opposite side walls 12. The insulative housing 1 defines at least two mating cavities 13 (one large and one small) opened at the front portion 16 and a like number of corresponding arranging openings 100 opened at the top portion 10 and communicating with a corresponding mating cavity 13, each mating cavity 13 and corresponding arranging opening 100 adapted for cooperatively receiving a mating connector (not shown). The mating cavities 13 are separated by a separating wall 14. A first receiving groove 101 is defined at one side of each arranging opening 100 and extends longitudinally through the top portion 10. A hole 102 is defined in the bottom surface of each first receiving groove 101. The rear side 11 defines a second receiving groove 111 for each first receiving groove, each of which communicates with and is perpendicular to the corresponding first receiving groove 101 in the top portion 10. A pair of through holes 112 is defined at both sides of each second receiving groove 111 and extending through the rear wall 11 of the insulative housing 1. The bottom wall 15 defines at least two insert openings 151 square in shape and communicating with a corresponding mating cavity 13. A plurality of projections 150 extends rearward from a front side of each insert opening 151 and are separated by a plurality of channels 155 therebetween. A pair of dovetail cutouts 152, stopping grooves 153 and recesses 154 (referring to FIG. 3A) are defined in both sides of each insert opening 151. Additionally, a plurality of guide grooves 110 are defined in an inside surface of the rear wall 11 and communicating with each mating cavity 13.

The terminal modules 2 and 2' have a similar structure, so only the terminal modular 2 is detailed hereinafter. The terminal modular 2 comprises a plurality of conductive contacts 21 being injection molded in a spacer 20. A pair of latching lugs 200, abutting blocks 201 and protrusions 202 are formed at both sides of the spacer 20. Additionally, the spacer 20 defines a plurality of retaining channels 204 in a front portion and forms a plurality of latching pins 203 at a rear end thereof. The conductive contacts 21 each comprise a contacting portion 210, a retaining portion 211 and a soldering portion 212 (referring to FIG. 3A). The retaining portions 211 thereof are integrally molded into the retaining channels 204 to retain the conductive contacts 21. The contacting portion 210 of each conductive contact 21 extends rearward and upward from the retaining portion 211. The soldering portions 212 extend downward from the spacer 20 for soldering to a printed circuit board (not shown).

Since the side walls 12 and the separating wall 14 of the insulative housing 1 do not need to provide any fixing devices for retaining inserted mating connectors, the width of the modular connector of the present invention is minimized. Additionally, the terminal modules can not be pushed out of place by repeated insertion of the mating connectors since the mating connectors are inserted perpendicular to the direction of the modules' insertion and the modules are securely retained in the insulative housing 1.

The conductive shell 3 is integrally formed for enclosing the insulative housing 1 to provide EMI shielding and comprises a front side 33 and an opposite rear side 31 (referring to FIG. 3C), a top side 30 and two opposite lateral sides 32. The front side 33 defines at least two receiving openings 34 and apertures 330 for correspondingly aligning with the mating cavities 13 and the first receiving grooves 101 of the insulative housing 1 respectively. A pair of grounding arms 331 are formed at either side of each receiving opening 34 and extend rearward from the front side 33 to conductively contact the mating connector. The top side 30 also defines at least two arranging apertures 301 for aligning with the arranging openings 100 in the insulative housing 1. The opposite lateral sides 32 define a pair of boardlocks 321 depending from bottom edges thereof to latched in a printed circuit board.

The indicating devices 4 each comprise a cover 40 and a light emitting diode (LED) 41. The cover 40 forms a protrusion 400 and an engaging portion 401 both of which depend downward from a bottom surface thereof. The lighting emitting diodes 41 each form a front end 411 and a pair of terminals 412 for signaling circuit transmission.

In assembly, the terminal modules 2 and 2' are inserted into the insert openings 151 from the bottom wall 15 of the insulative housing 1 and are retained therein by the latching lugs 200, abutting blocks 201 and protrusions 202 engaging respectively with the cutouts 152, stopping grooves 153 and recesses 154 of the insulative housing 1. Latching pins 203 of the spacer 20 partially engage with the guide grooves 110 in the insulative housing 1, and retaining portions 211 of the conductive contacts 21 engage with the channels 155 in the insulative housing 1. Each indicating device 4 is fitted in a corresponding first receiving groove 101 of the insulative housing 1 and the pair of terminals 412 thereof are inserted through the corresponding pair of through holes 112 in the rear wall 11 of the insulative housing 1. Each light emitting diode 41 is fixed in the insulative housing 1 by the cover 40, the protrusion 400 thereof being latched in the hole 102 and the engaging portion 401 thereof engaging with the second receiving groove 111. The shell 3 then encloses the insulative housing 1, the front ends 411 of the light emitting diodes 411 extending through the apertures 330 and the grounding arms 331 extending into grooves 121 defined in either side of each mating cavity 13.

It is noted that in this embodiment, the both two indicating devices 4 are positioned around the unit having the large cavity 13, and the side wall 12 beside the small cavity 13 is thinner than the other side wall 12 beside the large cavity 13. The arrangement allows the overall size of the whole assembly to have a minimum dimension thereof while still keeping proper reliable positioning and functioning of the built-in indicating device 4 thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular electrical connector comprising:

an insulative housing including a front portion, an opposite rear wall, a top portion and an opposite bottom wall, two mating cavities and a corresponding number of arranging openings being respectively defined in the front portion and the top portion for insertion of mating connectors, a first receiving groove being defined at one side of each arranging opening, the rear wall defining a corresponding number of second receiving grooves in communication with the first receiving groves, the bottom wall defining two insert openings, each insert opening communicating with a corresponding mating cavity and defining a plurality of receiving members in both sides thereof;

two terminal modules each comprising a spacer and a plurality of conductive contacts injection molded with the spacer, the spacer defining a plurality of retaining members at opposite sides thereof to engage with the receiving members of each insert opening, the terminal modules being inserted into the respective insert openings of the insulative housing;

a metal shell enclosing the insulative housing; and indicating devices each being fitted within the first receiving grooves and the second receiving grooves of the insulative housing;

wherein the insulative housing defines on an inside surface of the rear wall a plurality of guide grooves communicating with a respective mating cavity;

wherein each spacer of the terminal modules forms a plurality of latching pins at a rear end thereof to partially engage with the guide grooves in the insulative housing;

wherein a separating wall separates the two mating cavities of the insulative housing from one another;

wherein each first receiving groove defines a hole in a bottom surface thereof;

wherein the indicating devices each comprise a light emitting diode and a cover, and the cover forms an engaging portion and a protrusion both of which depend from a bottom surface thereof to respectively engage with the second receiving groove and the hole of the first receiving groove of the insulative housing;

wherein the plurality of conductive contacts each comprises a retaining portion which is retained in a respective channel defined in a front end of the insert opening of the insulative housing;

wherein the plurality of receiving members of the insert opening comprises a pair of cutouts, a pair of stopping grooves and a pair of recesses to respectively engage with a pair of latching lugs, a pair of abutting blocks and a pair of protrusions formed by the retaining members of the spacer;

wherein the shell defines in a front side thereof two receiving openings and two apertures for aligning respectively with the mating cavities and the first receiving grooves of the insulative housing;

wherein the shell defines in a top side thereof a number of arranging apertures equal in number to the arranging openings in the insulative housing and aligning with the arranging openings in the insulative housing.

* * * * *